United States Patent [19]

Jönsson et al.

[11] Patent Number: 4,828,539

[45] Date of Patent: May 9, 1989

[54] LIQUID PACK AND APPARATUS FOR THE PRODUCTION THEREOF

[75] Inventors: Bengt Jönsson, Dural; Sten Persson, St. Ives; David Wiggins, Blaxland, all of Australia

[73] Assignee: Tetra Pak International AB, Lund, Sweden

[21] Appl. No.: 152,050

[22] Filed: Feb. 4, 1988

Related U.S. Application Data

[62] Division of Ser. No. 810,852, Dec. 19, 1985, Pat. No. 4,744,467.

[30] Foreign Application Priority Data

Dec. 19, 1984 [DE] Fed. Rep. of Germany ..... 3446323
Jul. 31, 1985 [SE] Sweden ..... 8503653

[51] Int. Cl.[4] ..... B31B 1/60; B31B 1/88

[52] U.S. Cl. ..... 493/395; 493/58; 493/403; 493/467; 493/471; 493/962

[58] Field of Search ..... 493/52, 58, 60, 121, 493/128, 129, 158, 185, 326, 394, 395, 396, 403, 463, 464, 467, 471, 962

[56] References Cited

U.S. PATENT DOCUMENTS

| | | | |
|---|---|---|---|
| 2,015,268 | 9/1935 | Hammond | 206/48 |
| 2,259,822 | 10/1941 | Kienlen | 229/48 |
| 2,331,054 | 10/1943 | Shively | 154/42 |
| 2,472,883 | 6/1949 | Bergstein | 93/52 |
| 2,699,999 | 1/1955 | Mahler | 117/4 |
| 2,810,507 | 10/1957 | Saunders | 229/37 |
| 2,834,809 | 5/1958 | Schutte et al. | 493/395 |
| 2,899,349 | 8/1959 | Jenkins | 154/138 |
| 3,245,855 | 4/1966 | Stenvall | 156/152 |
| 3,270,940 | 9/1966 | Egleston et al. | 229/17 |
| 3,319,868 | 5/1967 | Huang et al. | 229/17 |
| 3,746,244 | 7/1973 | Bergstein | 229/37 |
| 4,518,377 | 5/1985 | Skinner | 493/58 |
| 4,555,022 | 11/1985 | Eagon et al. | 206/440 |

FOREIGN PATENT DOCUMENTS

| | | | |
|---|---|---|---|
| 231207 | 10/1960 | Australia | 229/48 T |
| 1536098 | 11/1971 | Fed. Rep. of Germany . | |
| 7607640 | 9/1977 | Fed. Rep. of Germany . | |
| 1459068 | 10/1966 | France | 206/438 |
| 82/04025 | 11/1982 | PCT Int'l Appl. | 229/17 G |
| 1024370 | 6/1983 | U.S.S.R. . | |
| 977700 | 12/1964 | United Kingdom . | |
| 1114620 | 5/1968 | United Kingdom . | |

*Primary Examiner*—Frederick R. Schmidt
*Assistant Examiner*—William E. Terrell
*Attorney, Agent, or Firm*—William J. Crossetta; Michael L. Dunn

[57] ABSTRACT

Described is a pack comprising a carrier material such as for example cardboard, which is coated with a thermoplastic material, for liquids, comprising a tube with a bottom and a cover which has a pouring spout, in the sealing region of which are disposed, beside sealing areas with a high adhesive force, sealing areas with a low adhesive force for the purposes of peeling the sealing areas apart.

In order not to be dependent on agents which impair the sealing effect and on the disposition thereof on certain regions in the cover, and in order for the tooling to be simplified, the invention provides that the sealing area (40') with a low adhesive force is formed by a pattern of raised surfaces (6) which alternate with areas (5) disposed therebeside and at a lower level. In the apparatus, there is provided an impressing roller with counter-pressure roller, wherein a line, disposed on the web of pack material, of successively disposed sealing areas can be passed through between the rollers, in the direction of movement of the web.

5 Claims, 4 Drawing Sheets

LIQUID PACK AND APPARATUS FOR THE PRODUCTION THEREOF

Figures 1, 2, 3, 4:
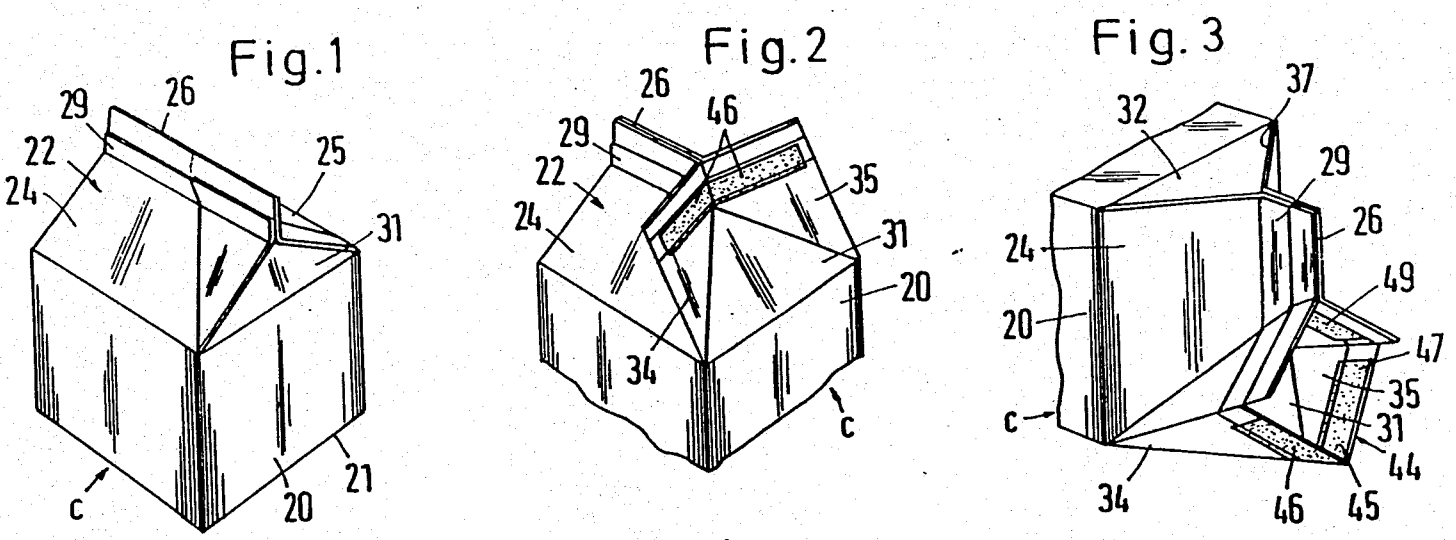

This is a Divisional of application Ser. No. 810,852, filed Dec. 19, 1985 U.S. Pat. No. 4,744,467.

The invention relates to a pack comprising carrier material such as for example cardboard, which is coated with a thermoplastic material, for liquids or the like, comprising a tubular main body with a bottom and a cover having a pouring spout which is to be opened by opening sealing seams and in the sealing region of which, besides sealing areas with strong adhesive force, there are sealing areas with a low adhesive force, for peeling the sealing areas apart. The invention further relates to an apparatus for the production of such a pack.

Packs are known, which have a gable-like closure on their top. Such packs are almost always produced from prefabricated blanks which have a suitable arrangement of fold lines which facilitate folding up and forming the packs, by folding into their definitive positions the panels or areas which form the upper portion and the bottom. The container blanks are nowadays mostly coated with a thermoplastic material, for example polyethylene, which is used both to make the pack liquid-tight and also to seal the pack by virtue of the application of heat and pressure so that it is satisfactorily folded and sealed in its erected condition. Milk is generally transported in such packs at the present time.

The upper portion or the cover of the known pack is to be opened by pulling the sealing seams apart, in such a way as to form a pouring spout for satisfactorily pouring out the contents of the pack.

The difficulty involved in packs of that kind, which are also as described in the opening part of this specification, generally lies in pulling the sealing seams apart for the purposes of forming the pouring spout. The sealing seams of a pack of that kind, which are sealed without particular precautions being taken, are so strong, for the purposes of ensuring that the pack is properly sealed, that the seams cannot be readily opened, in particular not without applying a substantial amount of force, and in most cases not without causing damage to the pack. For example, along the tubular main body and also in the bottom region thereof, the respective sealing seam is so strong that the pack does not readily burst open, even when subjected to a light blow. That is desirable while in the cover region also it is necessary to ensure that the pack is satisfactorily sealed. At the same time, the consumer wants a sealing seam which can be easily opened, at at least one location on the cover. That sealing seam can be referred to as peelable.

In the known packs, some seams are provided at least in part with a low level of adhesive force while the other seams which are in the vicinty thereof have a substantial adhesive force in order to keep the pack liquid-tight during transportation and prior to opening thereof.

There are various methods of producing sealing seams with a low level of adhesive force. In a first known embodiment, the regions of sealing seams which are to have a lower level of adhesive force than the adjoining ones are coated with an agent for impairing the sealing effect, for example silicone rubber. In a second construction, the regions which are to have a low level of adhesive force are coated with a special plastic material which has a higher sealing temperature than the remaining thermoplastic material. When then the sealing operation is carried out at lower temperature, the regions with a low adhesive force are in turn produced in the desired manner in the regions which have the special plastic material with a higher sealing temperature. In another third known construction, steps are taken in regard to the tooling to ensure that the sealing seam region with the low level of adhesive force is not heated to such a high degree as the other sealing seams, whereby the low level of adhesive force is also attained at the desired locations.

In the last case, the complicated construction of the tooling will be apparent. In regard to the first two examples set forth above, the disadvantageously expensive steps for applying different plastic material to different areas of adhesion will also be noted.

The object of the present invention is therefore so to improve the pack of the kind set forth in the opening part of this specification, and the apparatus for the production of the known pack, that there is no longer any dependency on an agent for impairing the sealing effect and on applying same to given regions in the cover, and the tool for producing the sealing areas with a low level of adhesive force, beside those with a high level of adhesive force, is simplified; especially as the application of different temperatures in adjoining regions involves serious difficulties on account of heat conduction.

According to the invention, in regard to the pack, that object is attained in that the sealing area with a low adhesive force is formed by a pattern of raised surfaces which alternate with areas which are disposed therebeside and at a lower level. The advantage of that simple configuration and design is that only limited regions of the carrier material which is coated with the plastic material come into contact with the heating jaws or sealing devices, in the "conventional" sealing operation. Although, by virtue of the pattern of areas of different heights within the cardboard coated with plastic material, it is possible to close a liquid-tight pouring opening, the forces required for opening it remain at a low level in the desired regions. It will be appreciated that the web of carrier material coated with thermoplastic material or the blank consisting of the coated cardboard, can be prepared by a preliminary treatment of very simple kind in the desired manner before being assembled and sealed.

In accordance with the invention, it is desirable in that respect if the raised surfaces are straight and/or curved ribs which are disposed at a spacing from each other and/or which periodically cross, wherein areas disposed between the ribs are at a lower level or vice-versa. In that way it is possible to achieve any graduation in respect of adhesive force, depending on the number of juxtaposed ribs or the width of the ribs. Conversely, it is possible to achieve a deviation from the normal strong adhesive force, to provide a lower level of adhesive force, by virtue of the provision of points which are at a lower level and the number and arrangement of which can determine the strength of the adhesive force.

Therefore, in accordance with the invention, another embodiment provides that the raised areas are a plurality of juxtaposed points and/or smaller surfaces, the periphery of which is of a cornered configuration and/or round.

Tests have shown that sealing jaws with the respective patterns of ribs or points have not given the desired result because the softness of the carrier material has afforded compensation in that respect insofar as levelling of that pattern occurred, towards the inward side of the layer of cardboard. Therefore, it is better if, in accordance with the invention, by virtue of preliminary treatment of the blank or the web from which the blank is cut, for example in conjunction with the grooving operation and possibly a pre-punching operation, the depressions beside the raised surface portions are provided by a preliminary treatment in such a way that the areas with the patterns are inserted into the welding station which has for example smooth sealing jaws. In that case, it is advantageously possible to produce the sealing effect only along those raised surface portions, while the portions which are disposed therebeside and which are at a lower level remain unsealed.

It is also advantageous in accordance with the invention if the sealing area which is on the pouring spout and which has a low level of adhesive force has an aperture. That ensures that, after the pack has been opened and re-closed, the adhesion of the sealing surfaces which are pressed together in the operation of re-closing the pack does not become too great so that the user then has difficulties when opening the pack on the second and third occasions. In that connection, it has turned out to be particularly desirable if, in accordance with the invention, the aperture is formed symmetrically with respect to the tip of the pouring spout in the form of a recess configuration because that facilitates production of the wall panel portions forming the pouring spout. A recess configuration is characterised in that a boundary line thereof is disposed at the outward edge. Such a recess configuration can be produced for example from a paper wall portion by cutting out a round piece at the outside edge, from the outside, by means of a pair of shears; or a square or rectangular panel portion; or a scalloped or indented region which looks like a triangle. In contrast the broader term "aperture", instead of the above-mentioned concrete embodiments, also includes holes or openings which are contained completely in the wall panel portion in question, without being open to the edge thereof. In contrast, the recess is always open to the edge. It is easier to produce, particularly when, in another advantageous embodiment of the invention, the recess is triangular and the apex of said triangle forms the tip of the pouring spout. The hypotenuse which is in opposite relationship to the apex could then be for example the cut edge of that sealing area, prior to the reduction in the size thereof. Specifically, the reduction in the size of the sealing area which has the lower level of adhesive force still further reduces the adhesive force thereof, in a highly simple manner.

Another embodiment of the invention is further characterised in that fold lines are disposed in the sealing areas of low adhesive force, which are disposed on the inclined surfaces forming the cover of the pack, which fold lines preferably extend perpendicularly into the doubled cardboard strip. That provides a pouring spout which is of a different configuration and which is easy to produce and which is good from the point of view of opening and use by the final consumer.

In regard to the apparatus, the above-specified object is achieved in that there is provided an impressing roller with counter pressure roller, wherein a line, on the web of pack material, of successively disposed sealing areas can be passed through between the impressing roller and the counter pressure roller, in the direction of movement of said web. The web of coated cardboard, being the web of pack material, or the blank which has already been separated off, is passed into the roll gap and receives the desired patterns of depressed surfaces at the desired locations which are disposed in line one behind the other in the direction of movement of the web or the blanks, while in the vicinity no depressions are formed, and are connected in known fashion in the subsequent sealing operation.

To produce the above-mentioned pack, it is desirable if, in accordance with the invention, on at least a part of its periphery, the impressing roller is provided with a pattern of raised configuration, which alternates with a pattern disposed therebeside and at a lower level. The blank or the web of pack material receives the impressing along that portion of the periphery of the impressing roller which carries the raised pattern, while over the remaining region the web of pack material or the line of blanks can slide through between the impressing roller and the counterpressure roller, without any impression effect being produced at specific surface portions. In other words, the impressing roller is of a larger diameter over a part of its periphery and of smaller diameter over the remaining part.

It is particularly desirable for the apparatus to be of a design configuration such that the raised areas of the pattern are straight and/or curved ribs which are disposed at a spacing from each other and/or periodically cross, wherein areas disposed between said ribs are at a lower level or vice-versa, or are a plurality of juxtaposed points and/or smaller areas, the periphery of which is of a cornered configuration and/or round. The pattern on the impressing roller may be of different patterns, as desired, so that in the processing operation the pack is provided with sealing areas of greater adhesive force, and other areas with a lower level of adhesive force, in accordance with the desired graduation. Although the surface pattern of the impressing roller may be of a complicated configuration in itself, the tool in its generality is however again extremely simple as it only consists of an impressing roller with a counterpressure roller.

Figure 5:
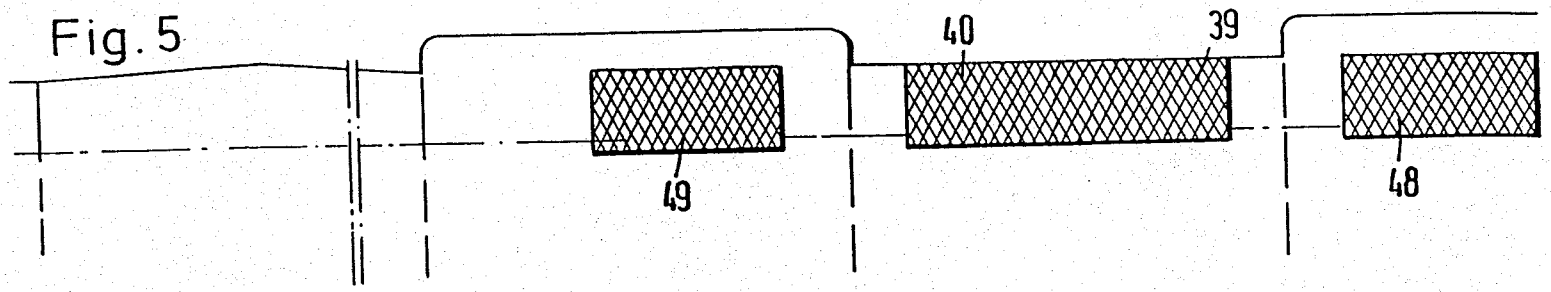
Figure 7:
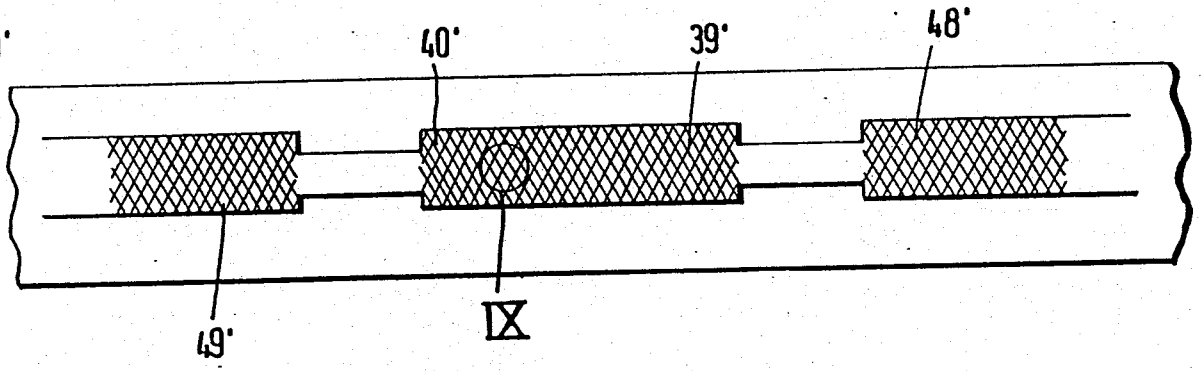
Figure 6:
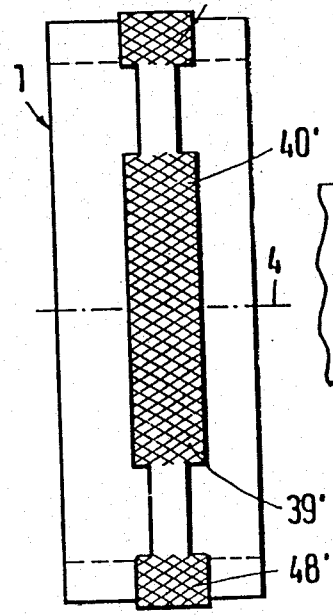
Figure 8:
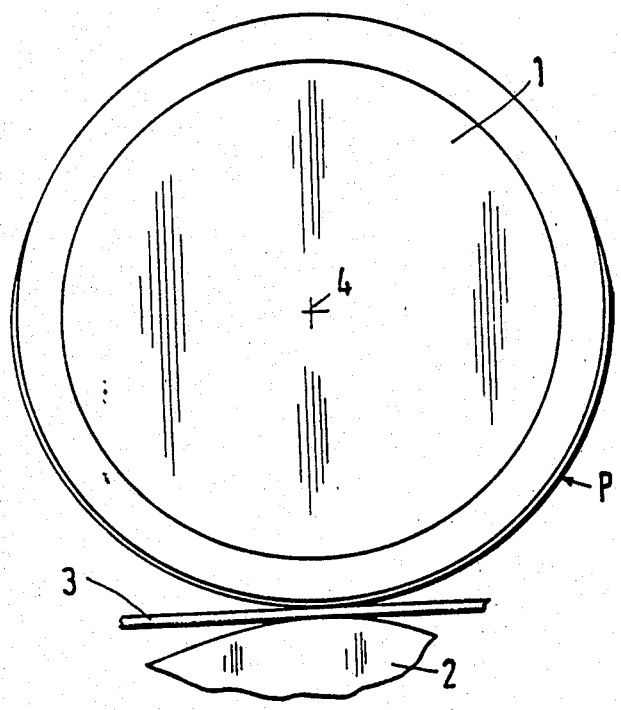
Figure 9:
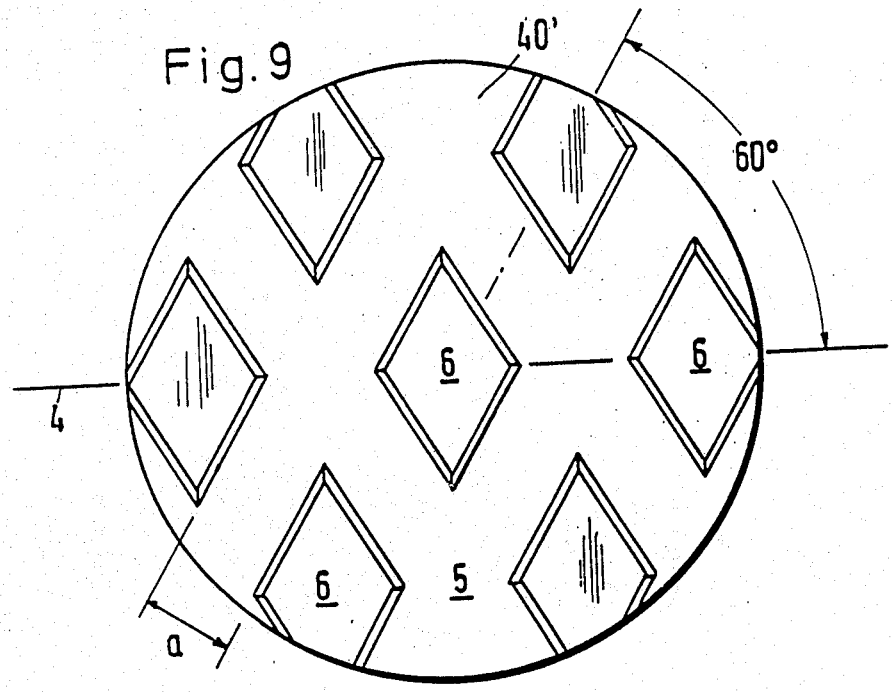
Figure 10:
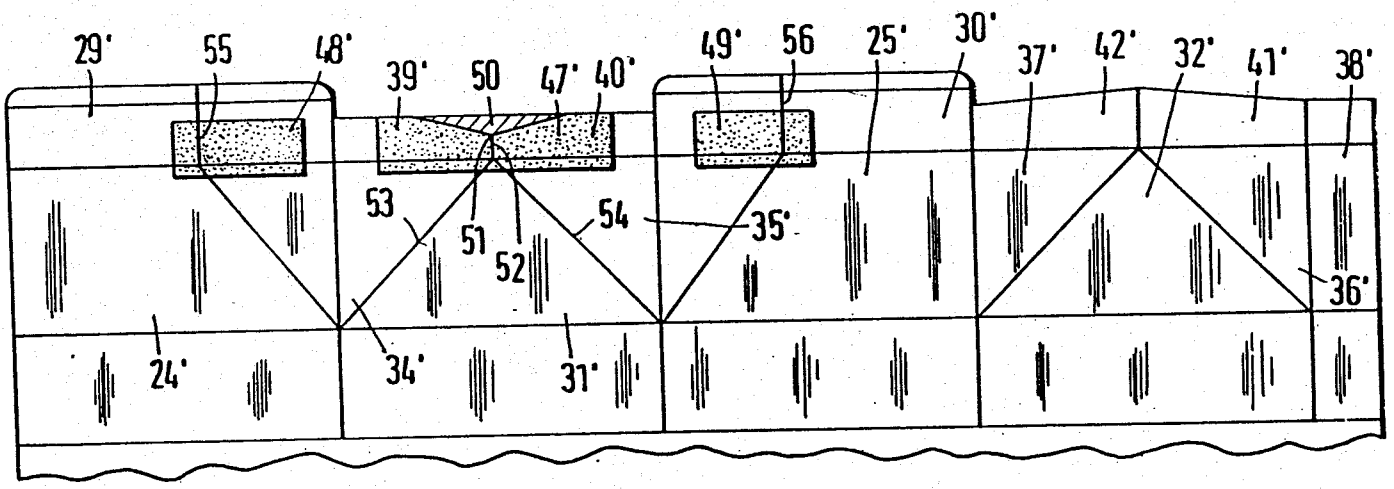

The invention provides that, to produce sealing seams with a low level of adhesive force, in the region of said sealing seams, certain portions of the coated web are depressed in such a way that they do not participate in the welding or sealing operation. The total sealing surface area is reduced as a result of that and consequently there is also a reduction in the adhesive force of the sealing seams which are finally produced. Further advantages, features and possible uses of the present invention will be apparent from the following description in conjunction with the drawings in which:

FIG. 1 is a perspective view of a pack with a gable-shaped cover in the closed condition, FIG. 2 shows the same pack as that illustrated in FIG. 1, but illustrating the first step for opening the pouring opening, FIG. 3 is a broken-away perspective top view onto the gable-shaped cover of the pack after it has been completely opened, FIG. 4 is a broken-away side view of the upper region of a blank as shown in FIG. 1, in a flat condition, with the fold lines and the sealing areas of low adhesive force, FIG. 5 is the same view as that shown in FIG. 4 in broken-away and more highly diagrammatic form, for enhanced clarity, upon comparison with the production tool, FIG. 6 is a plan view of the production tool, that is to say, the impressing roller, FIG. 7 shows the surface of the impressing roller in the flattened-out condition, with the ends being broken away, FIG. 8 is a side view of the impressing roller in the axial direction, that is to say, in a direction from right to left in FIG. 6, FIG. 9 shows a detail of the pattern in a preferred embodiment of the impressing roller, and FIG. 10 is a side view of another embodiment, the view being similar to that shown in FIG. 4, in accordance with the above-described embodiment.

The pack of which perspective views are shown in FIGS. 1 to 3 is generally identified by reference letter C. It has a tubular main body which is generally indicated by reference numeral 20, being of a configuration which is square or rectangular in cross-section, a bottom 21 and a gable-shaped cover which is generally denoted by reference numeral 22. The latter comprises two inclined surface portions 24 and 25 and a double-layer cardboard strip of which one layer is denoted by reference numeral 29 and the oppositely disposed layer is denoted by reference numeral 26.

As shown in FIG. 4, the tubular main body 20 is closed along the sealing seam 38. The laid-over gable surfaces 31 and 32 which are disposed approximately normal to the wall surface portions 24 and 25 are laterally connected to triangular panels 34, 35 and 36, 37 respectively, while upwardly towards the opening side, there are panels 30, 41 and 42 for forming the ridge seam.

The entire pack comprises paper or cardboard which is coated with thermoplastic material on both sides so that, when the sealing tools are of a suitable configuration, it is possible for the gable-shaped cover of the pack to be completely fluid-tightly closed off.

However, in the regions 39, 40, 48 and 49, there should be produced a sealing area with a low level of adhesive force, for which reason those surfaces are provided with the specific pattern 46, 47 and 49 respectively.

After the sealing operation which is slighter or weaker in extent over those regions 39, 40, 48 and 49, in such a way that those areas have a lower level of adhesive force and are consequently peelable, the pack can be put into the condition shown in FIG. 2 by a first step.

In order to prevent the sealing areas 48, 49, 39 and 40 with a low level of adhesive force from possibly clinging together again, when the container is opened, the invention provides the embodiment shown in FIG. 10. Illustrated therein is a prefabricated cardboard material, that is to say, a broken-away blank portion as shown in FIG. 4, but with minor alterations so that the pack produced from the blank shown in FIG. 10 represents a slightly modified construction in comparison with the pack which is produced from the blank, shown in FIG. 4. The same areas and portions in FIG. 10 as those appearing in FIG. 4 are denoted by the same reference numerals, but they are additionally provided with a prime. In order further to reduce the adhesive force, the sealing areas 39' and 40' have been reduced in size, for example by cutting away a centre portion 50 which in FIG. 10 is represented by inclined hatching and with boundary lines extending in a triangular configuration. Although the configuration of such a cut-away portion 50 may be different, it is however particularly useful for the cut-away portion to be of a V-shaped configuration, with the lower tip of the "V", which is identified by reference numeral 51 in FIG. 10, being disposed on a vertical fold line 52 which extends from the point of intersection between the corresponding fold lines 53 and 54 in the upper wall panel portions 31' and 34' of the preformed cardboard material. The V-shaped portion 50 is preferably in the form of an isosceles triangle whose apex 51 is disposed on the fold line 52. In accordance with a practical embodiment in that arrangement for example the hypotenuse or base may be about 25 mm and a corresponding height of the triangle may be 4 to 5 mm.

In the embodiment of the cardboard material which is shown in FIG. 10 and which is modified in comparison with FIG. 4, the two panel portions 24' and 25' which are arranged at the top of the pack may further be provided with fold lines 55 and 56 respectively which are partially arranged within corresponding sealing areas 48' and 49' respectively with a lower level of adhesive force. The extra fold lines 55 and 56 preferably extend vertically upwardly in the view shown in FIG. 10 and represent extensions corresponding to the fold lines 57 and 58 within the panel portions 24' and 25' respectively. That arrangement forms another pouring spout which is more easily formed, when the filled and closed pack C is to be opened and the content thereof is to be poured out.

It will be seen from FIG. 2 that the peelable sealing surface, in the region of the special pattern 46 (for example rhombic depressions arranged at a spacing from each other) can be opened in such a way that the two triangular panel portions 34 and 35 are pulled apart.

FIG. 3 then shows the condition after the pouring arrangement has been completely opened, specifically wherein the lip 45 of the pouring spout 44, which lip serves as the pouring spout means, has been folded out by releasing the pretreated sealing areas 47 and 49.

FIG. 5 again shows the blank illustrated in FIG. 4, but in a more highly diagrammatic form and in such a fashion as to permit easy comparison with the production tool. The sealing areas with a low level of adhesive force are again identified in the middle, on the right-hand side, by reference numeral 39, and on the left-hand side by reference numeral 40, while they are identified at outward positions at the sides by reference numerals 48 and 49.

For the purposes of producing such a pattern, use is made of an impressing roller 1 with counterpressure roller 2 which are shown in diagrammatic side view in FIG. 8. Only a small broken-away portion of the counterpressure roller 2 is illustrated in order to show the way in which the web 3 of pack material or the blank can be passed through between the two rollers 1 and 2. In FIG. 8 which is a view in the direction of the axis 4 of the impressing roller 1, disposed over half the periphery of the roller, that is to say, over a region of somewhat more than 180°, is a raised portion with a line of successively disposed sealing areas 49', 40', 39' and 48', that portion being generally denoted by P in order to be able to represent the larger outside diameter of that portion P in comparison with the diameter of the impressing roller 1.

If a view is taken onto the impressing roller 1 as shown in FIG. 8, with the web 3 and the counterpressure roller 2 being omitted, looking directly from below perpendicularly onto the axis 4, that gives the view shown in FIG. 6. Here too it is possible to see, extending downwardly, pattern areas 49', 40', 39' and 48' which are arranged in a line one behind the other and at least partly at a spacing from each other.

If the impressing roller 1 is developed into a plane, then that represents the surface shown in FIG. 7, wherein the two raised pattern areas 39' and 40' which are disposed directly adjoining without any spacing between them are disposed approximately at the centre while the pattern areas 48' and 49' are disposed at a spacing to the right and to the left thereof. Further to the right and to the left and outwardly thereof the remaining part of the periphery of the impressing roller 1 is broken away for there is no raised pattern area in that part, as can also be seen from the side view in FIG. 8, in the upper region thereof.

The detail indicated at IX in FIG. 7 is illustrated in FIG. 9. This generally concerns the raised pattern area 40' in which raised areas 5 (this structure involves the coherent main surface) alternate with areas 6 which are at a lower level and which are of a rhombic form. If the horizontal line 4 is again imagined as constituting the axis of the impressing roller 1, then, at an angle of 60°, there is a line of mutually spaced-apart, periodically disposed rhombic depressions arranged on the peripheral surface in such a way that the desired pattern is formed by the juxtaposed position of a multiplicity of such rows of rhombic areas.

The pattern shown in FIG. 9 can also be interpreted in a different fashion, to the effect that straight ribs cross, as raised surface 5, in such a way that the rhombic areas 6 which are at a lower level remain between the raised surfaces.

In another interpretation in which FIG. 9 represents for example a section from a sealing area with a low level of adhesive force, with a reversed tool, in which therefore the rhombic surfaces 6 are raised and the mutually intersecting ribs 5 which extend beside same are disposed at a lower level, that therefore gives a sealing area as shown in FIG. 5 at 39, 40, 48 and 49, in which the pattern which is then to be envisaged as shown in FIG. 9 and made up of the raised surfaces 6 alternates with the areas 5 which are disposed therebeside and at a lower level.

We claim:

1. An apparatus for forming a peelable sealing seam in a container, comprising impression roller means and cooperating counter pressure roller means, for pressing container material passing along a path both of said roller means having smooth, circumferential peripheral roller surfaces which cooperate with one another to form a container material, continuous nip which receives said, impression roller means additionally having die means outwardly extending from a portion of its peripheral roller surface for impressing a pattern into a sealing area portion of one surface of the container material passed between said nip, the pattern facilitating the formation of said peelable sealing seam, said die means having a pattern of raised surfaces which alternate with areas disposed therebeside having lower level surfaces and said die means being discontinuous about the circumferential periphery of the impression roller.

2. The apparatus of claim 1 wherein the pattern of raised and lowered surfaces comprises a plurality of spaced ribs which alternate with smaller juxtaposed structures.

3. The apparatus of claim 2 wherein the spaced ribs form the lowered surfaces and the smaller juxtaposed structures form the raised surface.

4. The apparatus of claim 2 wherein the pattern of smaller juxtaposed structures have a cornered configuration.

5. The apparatus of claim 2 wherein the pattern of the smaller juxtaposed structures have a round configuration.

* * * * *

UNITED STATES PATENT AND TRADEMARK OFFICE

CERTIFICATE OF CORRECTION

PATENT NO. : 4,828,539

DATED : May 9, 1989

INVENTOR(S) : Bengt Jonsson, Sten Persson and David Wiggins

It is certified that error appears in the above-identified patent and that said Letters Patent is hereby corrected as shown below:

Column 8, Claim 1, line 14, delete "container material,".

Column 8, Claim 1, line 15, delete "," and insert
-- container material, said --.

Signed and Sealed this

Sixth Day of February, 1990

*Attest:*

JEFFREY M. SAMUELS

*Attesting Officer* *Acting Commissioner of Patents and Trademarks*